United States Patent [19]

Shassere

[11] 4,197,951

[45] Apr. 15, 1980

[54] MOUNTING RACK FOR GUNS AND THE LIKE

[76] Inventor: Fred A. Shassere, P.O. Box 35865, Houston, Tex. 77096

[21] Appl. No.: 870,664

[22] Filed: Jan. 19, 1978

[51] Int. Cl.[2] ..... A47F 7/00; A47B 81/00

[52] U.S. Cl. ..... 211/64; 211/87; 248/224.2; 248/291

[58] Field of Search ..... 211/64, 87, 89, 60 R, 211/606, 60 T; 248/309, 291, 223.4, 224.2, 220.3, 220.4, 221.1

[56] References Cited

U.S. PATENT DOCUMENTS

| | | | |
|---|---|---|---|
| D. 183,293 | 7/1958 | Van Buren | 211/64 X |
| 2,290,545 | 7/1942 | Doering | 211/64 |
| 2,556,329 | 6/1951 | Hunter | 211/64 |
| 3,136,513 | 6/1964 | Selmyhr | 248/37.6 |
| 3,319,922 | 5/1967 | Christensen | 248/309 X |
| 3,484,069 | 12/1969 | Larson | 248/221.1 X |
| 3,743,224 | 7/1973 | Singer et al. | 211/4 X |
| 3,985,324 | 10/1976 | Larson | 248/221.1 X |

*Primary Examiner*—Roy D. Frazier
*Attorney, Agent, or Firm*—Gunn and Lee

[57] ABSTRACT

A mounting rack for guns is disclosed. In the illustrated two embodiments, the first depicts a plaque which is adapted to be fastened to the wall for display of the gun. The plaque incorporates a transverse angled slot, and an elongate bar is positioned in the slot. The first slot is transverse and angled with respect to the plaque. A second undercut slot is formed in the placque which accepts an insert having a protruding lip to lock in the undercut and thereby lock the bar in place. The bar carries a protruding rod suitable for insertion through the trigger guard of a rifle or shotgun and a second rod extends from the bar parallel to the first and the two together support a weapon on them. The alternate embodiment utilizes first and second plaque members which are suitably fastened together with the back face of the first plaque partially, centrally drilled to form an indentation and pie shaped, diverging, widening grooves extend from the circular indentation to the edge. A bar is pivotly mounted and is fixed by means of a bolt and clamp. The bar again carries two protruding parallel rods, one preferably round to extend through the trigger guard of a weapon and the second protruding bar serving as a cradle for the weapon.

5 Claims, 9 Drawing Figures

MOUNTING RACK FOR GUNS AND THE LIKE

BACKGROUND OF THE DISCLOSURE

Most shotguns and rifles are stored in and about the home. They can sometimes be stored very attractively by using a gun rack or cabinet. Gun cabinets typically have multiple shelves, glass windows, locking doors and other equipment which makes them terribly expensive. Many very simple gun racks exist which are comprised of a generally horizontal board with two protruding boards or pegs which support a rifle or a shotgun on them. They are, however, rather prosaic in appearance. By contrast, the present invention is uniquely adapted to suspend and support a rifle or shotgun at a rather jaunty angle. This gives a good deal more attractive support to the weapon. Moreover, it does not appear to be as sterotyped or monotonous as devices known heretofore.

The present invention is quite advantageous in cost, complexity, and installation as previous gun racks or cabinets. In particular, the present invention is able to be collapsed and folded into a very small container to be shipped. It breaks down into small pieces which themselves fit together, notwithstanding the fact that it has an extending, cantilevered arm.

BRIEF SUMMARY OF THE ILLUSTRATED DEVICES

The present invention is a gun rack having two embodiments. In the first embodiment, it is formed of three pieces. One piece is a plaque which has intersecting slots or grooves cut in the back face. One extends transversely across it to align a bar, and the bar supports forwardly protruding rods, one extending into the trigger guard to catch the weapon and the other notched to form a cradle holding the weapon near the forestock. The third piece is a short lock member. It slides along and into the second groove and passes over the bar. Because the two grooves intersect, the bar which is installed first is locked in position by the lock member. The lock member has enlarged edge located shoulders.

The second embodiment is formed of first and second plaque members. They are bolted together. The back face of the first has a circular shallow indentation formed in it and a pair of diverging grooves extending from it. The grooves themselves are able to receive the bar, the bar supporting end located rods for supporting a weapon. The bar is attached in the circular indentation by means of a bolt and clamp.

DRAWINGS

DETAILED DESCRIPTION OF THE PREFERRED EMBODIMENTS

Figure 1:
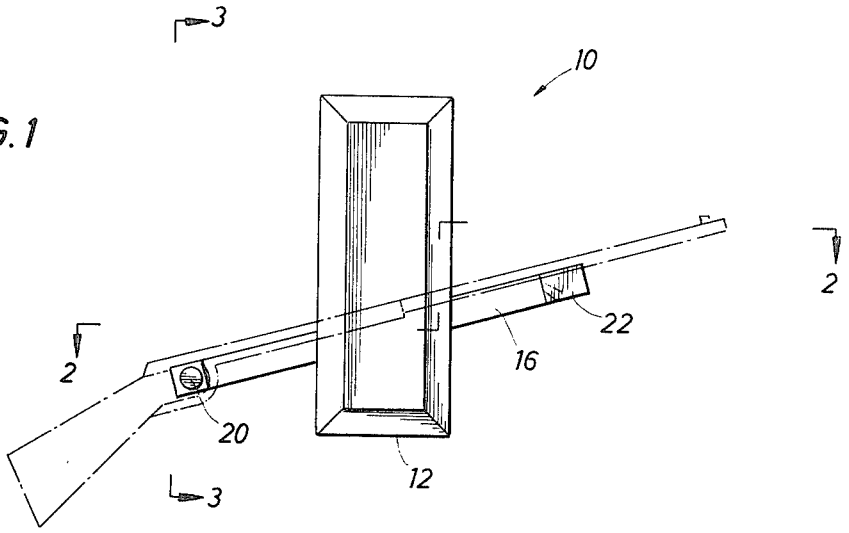
FIG. 1 is a front view showing a first embodiment of the present invention mounted on the wall and adapted to support a weapon on rods protruding from an angled bar.

In FIG. 1 of the drawings, the numeral 10 identifies a weapon mounting apparatus. The apparatus is formed of three basic pieces. The first piece is a decorative plaque 12. The plaque 12 is beveled around the edges, is formed of an attractive grade of wood which is clear and free of knots, is decoratively painted or varnished as desired, and is otherwise made attractive to enhance the appearance of the present invention. The plaque 12 is not very large although it can be made as large as necessary. It is typically formed of board stock having a width ranging from 4 to about 10 inches. An optimum size is about 6 inches. The height can range anywhere between about 6 inches to 2 feet with the optimum being about 10 or 12 inches. The measures which are given here in part are limited to provide a most attractive plaque. Indeed, the plaque can be engraved, and otherwise enhanced to improve its beauty.

Figure 5:
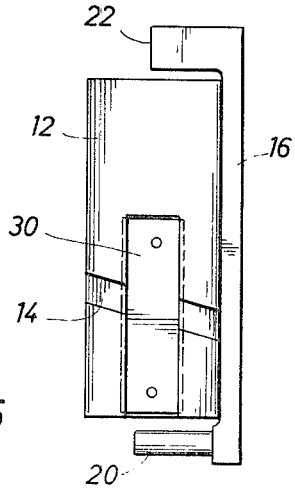
FIG. 5 is view depicting the components of the present invention in a disassembled state, and nested together showing how they neatly and conveniently fit in a carton for shipping.

The plaque is reasonably thin, but it is sufficiently thick to receive two grooves across the back. The first groove is identified by the numeral 14 in FIG. 5. This groove is rectangular in cross-section. It extends from one edge to the other and completely crosses the plaque. This groove is located at an angle with respect to the horizon or reference. This groove is cut to a specified depth to accomodate or to receive a transverse bar 16. The bar 16 has a width and height which fits in the groove 14. The width and thickness of the bar 16 is sized to fit snugly in the groove. The groove is formed to a depth which does not structurally weaken the plaque or otherwise leave a thin webbing joining the upper and lower portions on opposite sides of the groove. The bar 16 is rectangular in cross-section throughout its full length. However, it is notched at a central portion for purposes to be described.

The bar 16 supports a protruding circular stub or post 20 which is adapted to be inserted through the trigger housing of a rifle or shotgun. It is at one end of the bar. Preferably, it is at the end of the bar which is installed at a lower elevation relative to the opposite end. The opposite end of the bar 16 supports a protruding post 22. While the post 20 is circular, the member 22 is generally rectangular and moreover, it is notched on its top face to define a relatively shallow groove for supporting the forestock or barrel of the weapon rested on it. It will be understood that the bar 16 and the appendages at each end are attractively cut and shaped and then finished. They are artistic in appearance to serve as an accent piece for supporting a weapon. The span between the members 20 and 22 is something in the vicinity of 10 to 20 inches depending on the scale of the weapon. It is not normally necessary that the distance be any greater.

Figure 4:
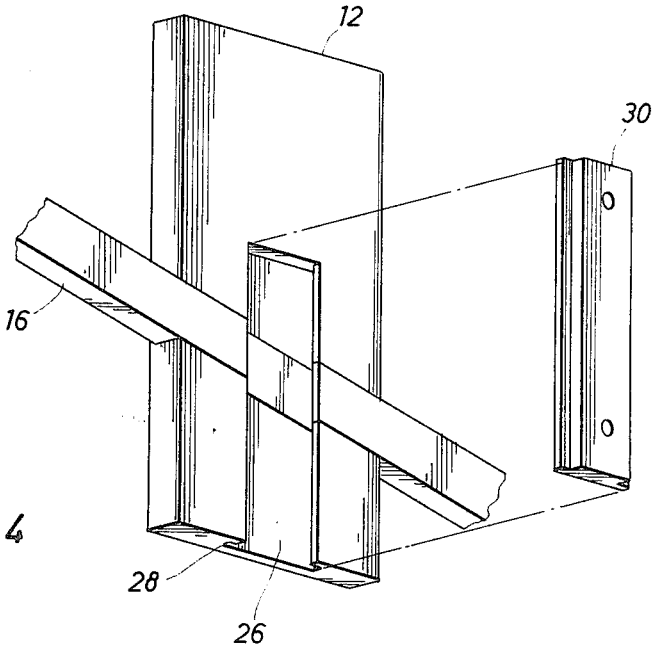
FIG. 4 is a back view of the plaque which shows intersecting grooves cut therein and a means which locks the bar in position.

The back face of the plaque 12 is shown in FIG. 4 of the drawings. There, a groove 26 is cut approximately to the midpoint. The groove 26 is parallel to the major axis of the plaque. Preferably, it is spaced evenly between the two edges. The groove 26 is undercut at 28 on both edges. The undercut defines a type of T-slot for locking purposes. It will be noted that the groove 26 intersects the groove 14. Indeed, the undercut disappears from the plaque 12, but the bar 16 itself is transversely intersected by a matching groove. In other words, the bar 16 is cut with a transverse angled groove so that the matchup in groove segments achieved in FIG. 4 is accomplished when the bar 16 is fitted against the plaque. It may be necessary to slide the bar 16 along its major length to achieve good alignment. It will be observed that the groove 26 is relatively shallow, and is definitely not as deep as the groove 14. This enables the bar 16 to be cut without weakening, the cut extending across the waist of the bar and further defining undercut slots to enable a locking member to be inserted into the groove in the plaque 12 and to additionally lock the bar 16 in place.

Figure 2:
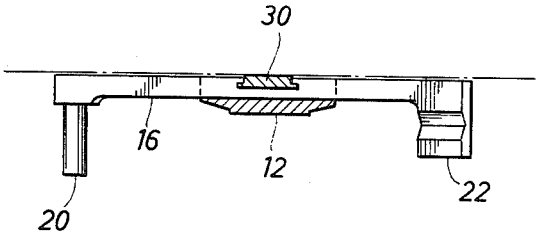
FIG. 2 is a view taken along the line 2—2 of FIG. 1 showing how the bar is locked in position to the wall mounted plaque.
Figure 3:
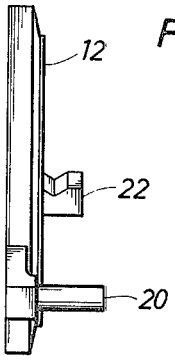
FIG. 3 is a view taken along the line 3—3 of FIG. 1 showing the angled bar which supports the weapon.

A mounting member 30 is illustrated in the drawings. The locking member 30 has a cross-section which is cut with overhanging shoulders to fit in the T-slot which is found in the groove 26. The locking member, when inserted in the groove 26, fills that groove and protrudes only slightly from the rear of the plaque as shown in FIG. 2 of the drawings. The locking member 30 is able to be bolted, glued, screwed, nailed, or otherwise affixed to a wall. It is not seen once the equipment is installed. As a consequence, it can be conveniently nailed or attached in some suitable fashion to the wall. It need not be very large, typically having a width of about one inch and a height of up to about eight inches. It is affixed to the wall before the plaque is attached.

The three pieces are thus assembled in the following manner. The bar 16 is placed in the groove 14 on the back of the plaque. It is positioned with the round trigger guard support at the lower end, and then it is moved axially in the transverse groove 14 until the notch in the bar matches the undercut groove 26. At this juncture, the mounting member 30 can be inserted. More accurately, the mounting member 30 is customarily attached to a wall and the plaque, held above it, is affixed to it by downward sliding movement. When the mounting member 26 slides to the upper end of the groove 26, the plaque is mounted and more importantly, the bar which supports the weapon is locked in position. It cannot slide axially and it cannot rotate.

The apparatus can be disassembled by reversing the sequence of assembly. This enables it to travel neatly, conveniently and easily in a common package or container as exemplified in FIG. 5 where the parts are shown nested together. As observed in FIG. 5, the bar 16 is sufficiently long that the members 20 and 22 encompass the enclose the plaque 12.

Figure 6:
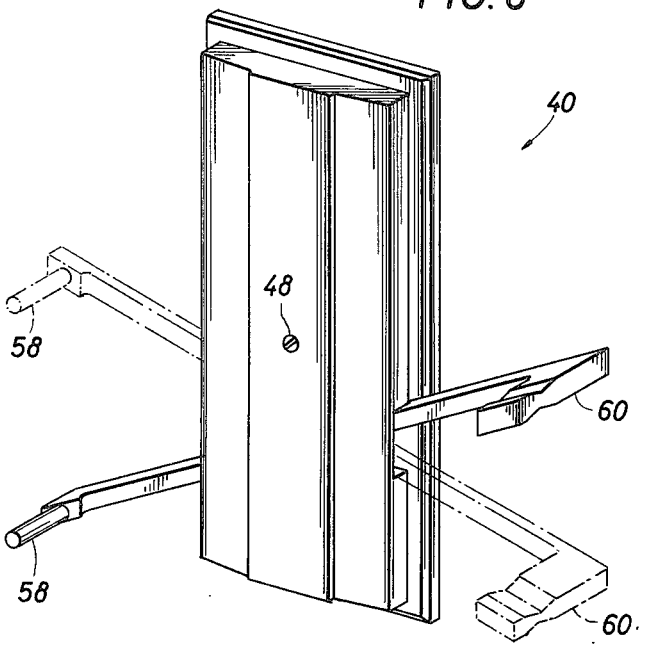
FIG. 6 is a perspective view of an alternate embodiment which shows how the bar can be positioned at various angles to accommodate a different angle of inclination when mounting a weapon on the wall.
Figure 9:
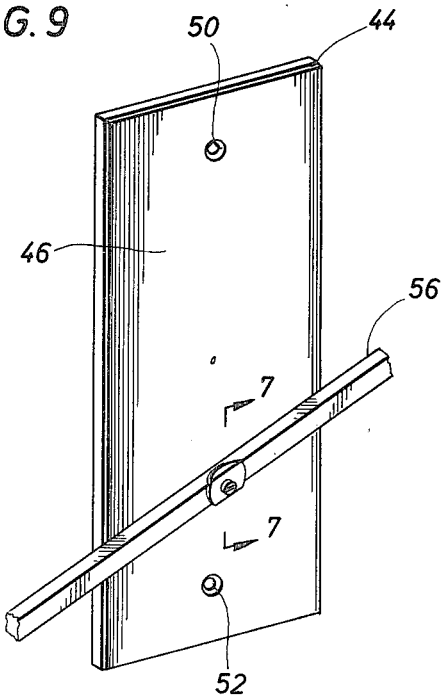
FIG. 9 is a perspective view showing the front of the second plaque which mates with the back of the plaque shown in FIG. 8 and illustrating how the bar is positioned at a variable angle.
Figure 8:
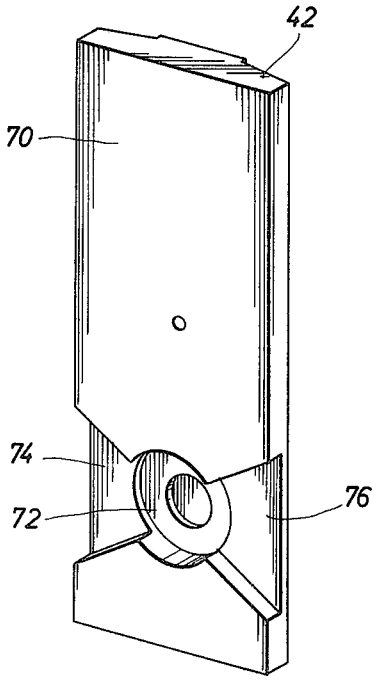
FIG. 8 is a back perspective view of the wall mounting plaque showing how it is shaped to accommodate positioning of the bar at different angles.

In FIG. 6 of the drawings, the numeral 40 identifies an alternate embodiment. It is formed of a front plaque 42 shown in FIG. 8. It is rectangular in profile and it is slightly smaller than a back plaque 44 shown in FIG. 9. The face 46 of the plaque 44 is covered over. Only the border shows. Accordingly, the border is finished and can be shaped as shown in FIG. 9 with some decorative edging. The plaque 42 has a front face which itself is made decorative in some fashion. It may incorporate special shapes, profiles, wood finishes and so on. The two plaques are joined together by a suitable means such as a wood screw 48 identified in FIG. 6. The plaque 44 is affixed to a mounting wall by placing screws, bolts, etc. in openings at 50 and 52 shown in FIG. 9. The two plaques, when joined together, support a transverse bar 56. The bar 56 includes a protruding round pin 58. The numeral 60 identifies a rectangular protruding member. Members 58 and 60 are preferably identical to the members 20 and 22 shown in the embodiment 10 and they function similarly to support a weapon. Thus, they are about 10 to 20 inches apart depending on the scale of the weapon.

Figure 7:
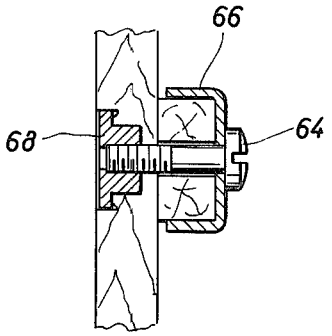
FIG. 7 is a detailed sectional view through a clamp and bar mechanism which is joined together by a bolt.

The bar 56 is drilled and a bolt 64 passes through it as shown in FIG. 7. The bolt locks in position a U-shaped clamp member 66 which saddles the bar. The bolt extends into a recessed nut 68 which reinforces the wood which is favored in the construction of the present invention. The nut 68 is a special nut which is embedded in a counter sunk hole on the rear face to provide a set of threads which do not wear out with continued usage as might occur if the threads were formed in wood.

When the bolt 64 is tightened, it clamps the bar 56. The bar is first positioned at a selected angle relative to the horizontal. Once the angle is selected, it determines the angle at which the weapon is inclined for decorative purposes.

The plaque 42 includes a back face 70 which is generally planar. A circular depression 72 is formed. It is aligned along the centerline of the device to cover over the bolt head 64 and the clamp 66. It is deep enough to receive them in it without binding. The generally circular cavity 72 serves as a counter-sunk opening to receive the bolt head and the clamp. In addition to the cavity, wedge shaped recesses 74 and 76 of symetrical construction are arranged in the right and left and extend to the edges of the plaque 42. They have a depth which is sufficient to receive the bar 56. They extend at angles to define a pie-shaped void which permits the bar 56 to be positioned at an angle with respect to the horizon. The bar can be pivoted to a specified angle, depending on where the user wishes to locate it. The bar 56 is thus pivoted to the desired angle with the bolt 64 loose and thereafter, the bolt is tightened.

The device is assembled in the following manner. The plaque 44 is attached to the wall. The bar 56 is positioned at a desired angle. The bolt 64 is tightened to clamp the bar firmly against the plaque. Then, the front plaque 42 is attached in some suitable manner as by tightening the wood screw 48. This completes the installation of the embodiment 40. It is disassembled by reversing the sequence described above. It is easily shipped by removing the bolt 64 and nesting the bar 56 against the larger plaque 44. The two plaques are laid over one another for ease of shipment and packaging.

Many alterations and modifications can be incorporated, in particular, those concerned with increasing the attractiveness of the device. Moreover, they are able to be modified with a great variety of finishes, decorative enhancements, decals and so on.

The foregoing is directed to the preferred embodiments but the scope of the present invention is determined by the claims which follow.

I claim:

1. Apparatus for mounting a rifle or shotgun decoratively on a wall, comprising:

(a) a generally vertical plaque;

(b) an elongate arm adapted to be positioned behind the front of said plaque and having two ends, each end comprising a protruding weapon supporting means for upholding a weapon placed thereon;

(c) means for securing said arm to said plaque at an angle determined by said means and which means comprises:

(1) a transverse groove means behind the exposed front of said plaque;

(2) said arm being constructed and arranged to fit in said groove means and extend beyond the edges of said plaque at both ends thereof;

(3) wherein said arm positions said support means sufficiently forward of said plaque to enable a weapon to be positioned in front of said plaque;

(4) a second groove means on said plaque which intersects said first groove means, said second groove means having an undercut therealong to enable a locking means having a profile matching said undercut to enable said locking means to be inserted thereinto to affix said plaque to a wall by nailing or otherwise fastening said locking means to a wall; and (5) wherein said locking means comprises an elongate member sheathed in said second groove means on assembly of said arm, said plaque and said locking means.

2. The apparatus of claim 1 wherein said locking means is generally rectangular and has an edge profile fitting into said second groove means at the undercut thereof which can be removed only on lengthwise sliding movement from said second groove means.

3. The apparatus of claim 2 including a notch cut across said arm having a width, depth, and angular position to enable said locking means to span across said first groove means and thereby extend through said arm notch to prevent sliding movement of said arm in said first groove means.

4. The apparatus of claim 3 including a first and a second sides on said first groove means which are interrupted at said second groove means and wherein said notch on said arm is confined between said sides,and said arm must be aligned relative to said second groove means on insertion of said locking means.

5. The apparatus of claim 4 wherein said plaque has a maximum dimension which is less than the spacing along said arm between said weapon supporting means to enable said plaque and said arm to be positioned in a common plane for ease of packaging prior to assembly.

* * * * *